United States Patent [19]

Runions

[11] 4,380,524

[45] Apr. 19, 1983

[54] CEMENT APPLYING MACHINE AND METHOD

[75] Inventor: Sinville Runions, Booneville, Miss.

[73] Assignee: International Shoe Machine Corporation, Nashua, N.H.

[21] Appl. No.: 27,561

[22] Filed: Apr. 6, 1979

[51] Int. Cl.[3] ..... B05C 3/02

[52] U.S. Cl. ..... 264/263; 118/411; 118/412; 425/110; 425/129 S

[58] Field of Search ..... 425/447, 110, 129 S; 264/263; 118/411, 412

[56] References Cited

U.S. PATENT DOCUMENTS

| | | | |
|---|---|---|---|
| 3,304,563 | 2/1967 | Fino | 12/12.5 |
| 3,422,474 | 1/1969 | Kamborian et al. | 14/145 |
| 4,082,060 | 4/1978 | Vornberger | 118/411 |

*Primary Examiner*—James H. Derrington

[57] ABSTRACT

A machine for applying cement in the corner between the unwiped portion of the margin of a shoe upper mounted on a last and the corresponding portion of the periphery of an insole located on the last bottom by a pair of nozzles that each has a laterally projecting tip wherein the toe portion of the upper margin has been wiped against and secured to the insole and segments of the upper margin at the boundaries between the wiped and unwiped margin portions overhang the insole. The nozzles are caused to apply cement in the corner while moving from the heel end extremity of the corner to locations beneath the margin segments, after which the nozzle tips are moved inwardly of the segments and are then moved away from the insole. The nozzles are placed at the heel end extremity of the corner by being moved downwardly against the insole while the tips face the heel and extremity of the insole and are then moved heelwardly to positions wherein the nozzles are proximate to the heel end of the upper margin.

3 Claims, 24 Drawing Figures

CEMENT APPLYING MACHINE AND METHOD

BACKGROUND OF FIRST ASPECT OF THE INVENTION

U.S. Pat. No. 4,082,060 discloses a prior art machine, operable on a shoe assembly formed of a last having an insole located on its bottom and an upper mounted thereon with a portion (the toe portion) of the upper margin being wiped against and secured to the insole and with an unwiped portion of the upper margin, extending rearwardly of the wiped margin portion, projecting away from the insole periphery and with a segment of the upper margin at the boundary between the wiped and unwiped margin portions overhanging the insole. The machine has the function of applying cement in the corner between the unwiped margin portion and the corresponding portion of the insole periphery between a rearward position that is spaced from the boundary and a forward position that is located at the boundary. In the machine, the shoe assembly is so supported bottom-up that the wiped margin portion is forward of the unwiped nozzle portion; a nozzle, having a laterally projecting tip through which cement may be extruded, is located above the shoe assembly; the nozzle is initially located in a lower nozzle position in engagement with the shoe assembly bottom and in a forward position that is located at the boundary; the nozzle is thereafter moved in a cement applying stroke to a rearward position that is rearward (heelward) of the boundary; the nozzle is so constrained during the cement applying stroke that the nozzle tip is in the corner with the nozzle tip projecting outwardly of the nozzle and being beneath the margin segment at the beginning of the cement applying stroke; cement is extruded through the nozzle tip into the corner during the cement applying stroke; and the nozzle is then raised away from the shoe assembly bottom.

SUMMARY OF FIRST ASPECT OF THE INVENTION

In certain shoe assemblies, the side portions of the upper are formed of two segments that are stitched to each other so as to form inwardly extending ridges that face forwardly and the insole forepart and shank portions are so connected to each other as to form an upstanding ridge that faces forwardly. It has been found that in the prior art machine, with the nozzle moving rearwardly (heelwardly) in its cement applying strokes, the nozzle tends to snag on the ridges which adversely affects the cement applying stroke. In order to overcome this disadvantage, the prior art machine of U.S. Pat. No. 4,082,060 has been modified to cause the nozzle to move forwardly (toewardly) in its cement applying stroke, as is broadly taught in U.S. Pat. Nos. 3,304,563 and 3,422,474. With the nozzle moving forwardly in its cement applying stroke and being located beneath the upper margin segment at the boundary at the conclusion of the cement applying stroke, difficulties arise in removing the nozzle from beneath the upper margin segment at the conclusion of the cement applying stroke without smearing the nozzle on the previously applied cement. In accordance with the first aspect of the invention, this difficulty is overcome by moving the nozzle tip inwardly of the overhanging margin segment prior to moving the nozzle away from the shoe assembly by swinging the nozzle rearwardly and inwardly about a heightwise axis.

BACKGROUND OF SECOND ASPECT OF THE INVENTION

U.S. Pat. No. 3,304,563 shows a prior art machine operable on a shoe assembly formed of a last having an insole located on its bottom and an upper mounted thereon with a portion of the upper margin from its heel end extremity extending toewardly thereof projecting away from the insole and with the heel end extremity of the upper margin being folded towards the insole. The machine applies cement in the corner between the margin portion and the corresponding portion of the insole periphery and comprises: a shoe assembly support for supporting the shoe assembly bottom-up with the toe end of the shoe assembly facing forwardly; a nozzle, located above the shoe assembly, through which cement may be extruded; forward-rearward moving means for effecting forward-rearward movements of the nozzle between a rearward nozzle position wherein the nozzle is proximate to and forward of the heel end of the margin portion and a forward nozzle position wherein the nozzle is at the forward end of the margin portion; heightwise moving means for effecting heightwise movements of the nozzle between an upper nozzle position wherein the nozzle is spaced above the insole and a lower nozzle position wherein the nozzle is in engagement with the insole; means for causing the heightwise moving means and the forward-rearward moving means to initially retain the nozzle in the upper nozzle position with the nozzle in an intermediate forward-rearward position that is between the rearward nozzle position and the forward nozzle position and is relatively close to the rearward nozzle position; means for thereafter causing the heightwise moving means to move the nozzle downwardly and rearwardly to place the nozzle in its lower and rearward nozzle position; means for thereafter causing the forward-rearward moving means to effect forward movement of the nozzle in a cement applying stroke; means effective during the cement applying stroke to retain the nozzle in the corner; and means effective during the cement applying stroke to extrude cement through the nozzle into the corner.

SUMMARY OF SECOND ASPECT OF THE INVENTION

In the machine of U.S. Pat. No. 3,304,563, the nozzle is moved downwardly and rearwardly by a parallel linkage mechanism which enables the nozzle to clear the folded heel end extremity of the upper margin and still engage the insole in the rearward nozzle position proximate to the heel end extremity of the upper margin. The second aspect of the invention provides an improved arrangement for accurately locating the nozzle in the rearward nozzle position while enabling the nozzle to clear the folded heel end extremity of the upper margin during the downward movement of the nozzle from the upper nozzle position. This is accomplished by the machine of this invention comprising: a post mounted for forward-rearward movement in unison with the nozzle; a rod, constructed similarly to the rod 284 in U.S. Pat. No. 4,082,060, mounted for forward-rearward movement between a front rod position and a back rod position, located rearwardly of and in intersecting relationship with the post; means for initially causing the rod to be in the front rod position;

means for initially causing the forward-moving means to yieldably move the nozzle, together with the post, rearwardly with the post engaging the rod in a location wherein the nozzle is in the intermediate position; means for thereafter causing the heightwise moving means to lower the nozzle to the lower nozzle position; and means for thereafter causing the rod to be moved to the back rod position thereby enabling the forward-rearward moving means to move the post, together with the nozzle, rearwardly an amount corresponding to the amount of rearward movement of the rod from the front rod position to the back rod position to thereby place the nozzle in the rearward nozzle position.

BACKGROUND OF THIRD ASPECT OF THE INVENTION

The nozzle of the machine of this invention, during its forward movement, moves along a segment of the insole that is inclined upwardly and forwardly with the remainder of the insole that is traversed by the nozzle not being so inclined. As in the machine of U.S. Pat. Nos. 3,304,563 and 4,082,060, the nozzle of the machine of this invention is yieldably urged downwardly under a prescribed force against the insole during the forward movement of its cement applying stroke.

SUMMARY OF THIRD ASPECT OF THE INVENTION

When the nozzle is travelling along the upwardly and forwardly inclined insole segment while being yieldably urged downwardly under the prescribed force, there is an undesired resistance to the forward movement of the nozzle and an undesired tendency of the nozzle to dig into and gouge this upwardly and forwardly inclined insole segment. In acordance with this invention, to alleviate this problem, the machine incorporates relief means to relieve the downwardly directed prescribed force; a control member actuable to actuate the relief means; and an actuating member so constructed and arranged as to actuate the control member during that portion of the cement applying stroke wherein the nozzle is moving along the upwardly and forwardly inclined insole segment.

The third aspect of the invention has utility in organizations using tools other than a cement applying nozzle for performing work on workpieces other than an insole. For example, this aspect of the invention has utility wherein a knife is cutting an incision in a workpiece.

DESCRIPTION OF THE PREFERRED EMBODIMENT

Figure 1:
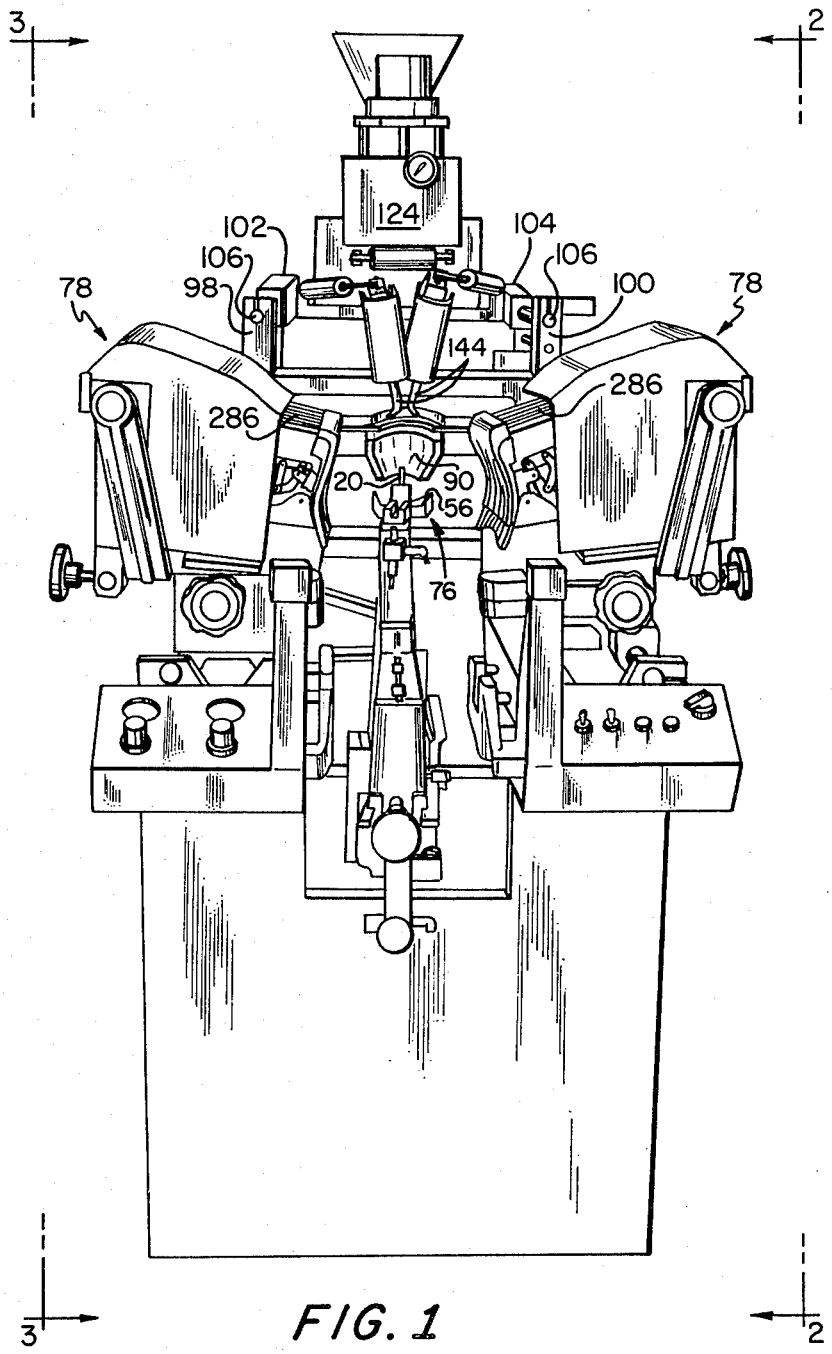
FIG. 1 is a front elevation of the machine of this invention.
Figure 2:
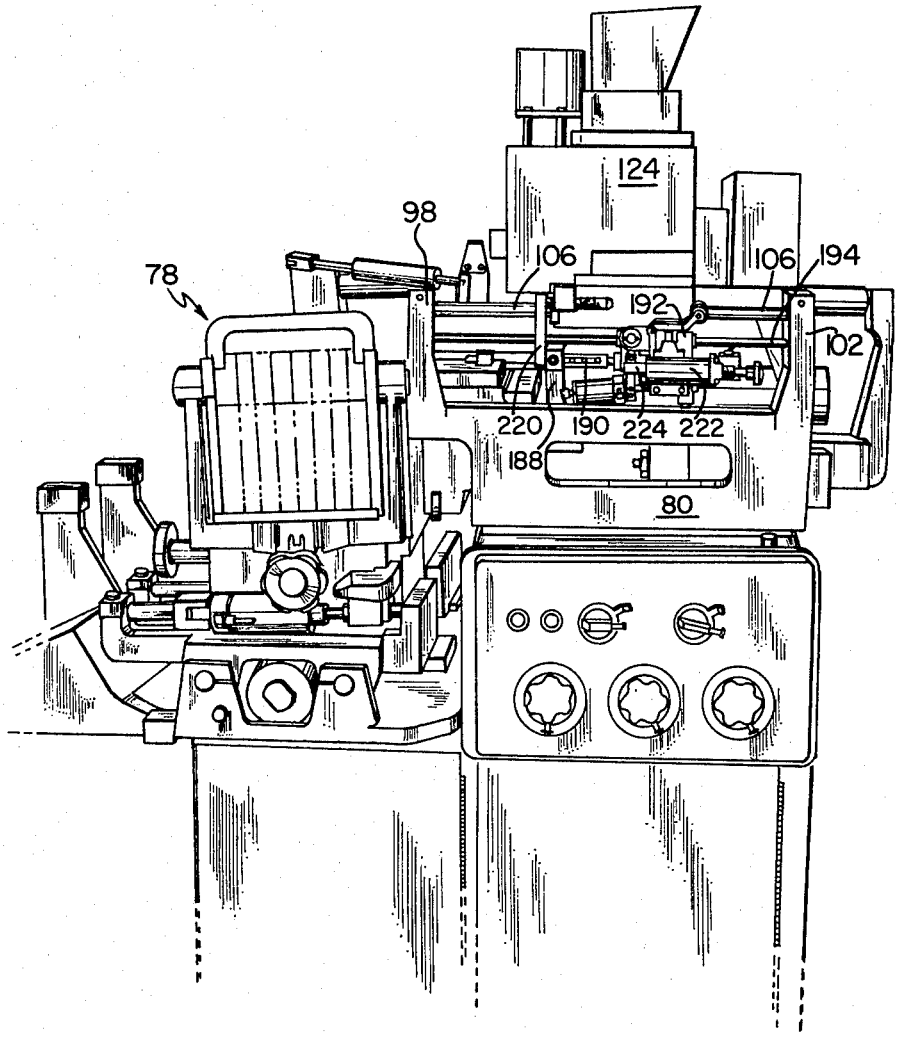
FIGS. 2 and 3 are side elevations of the machine respectively taken along the lines 2—2 and 3—3 of FIG. 1.
Figure 3:
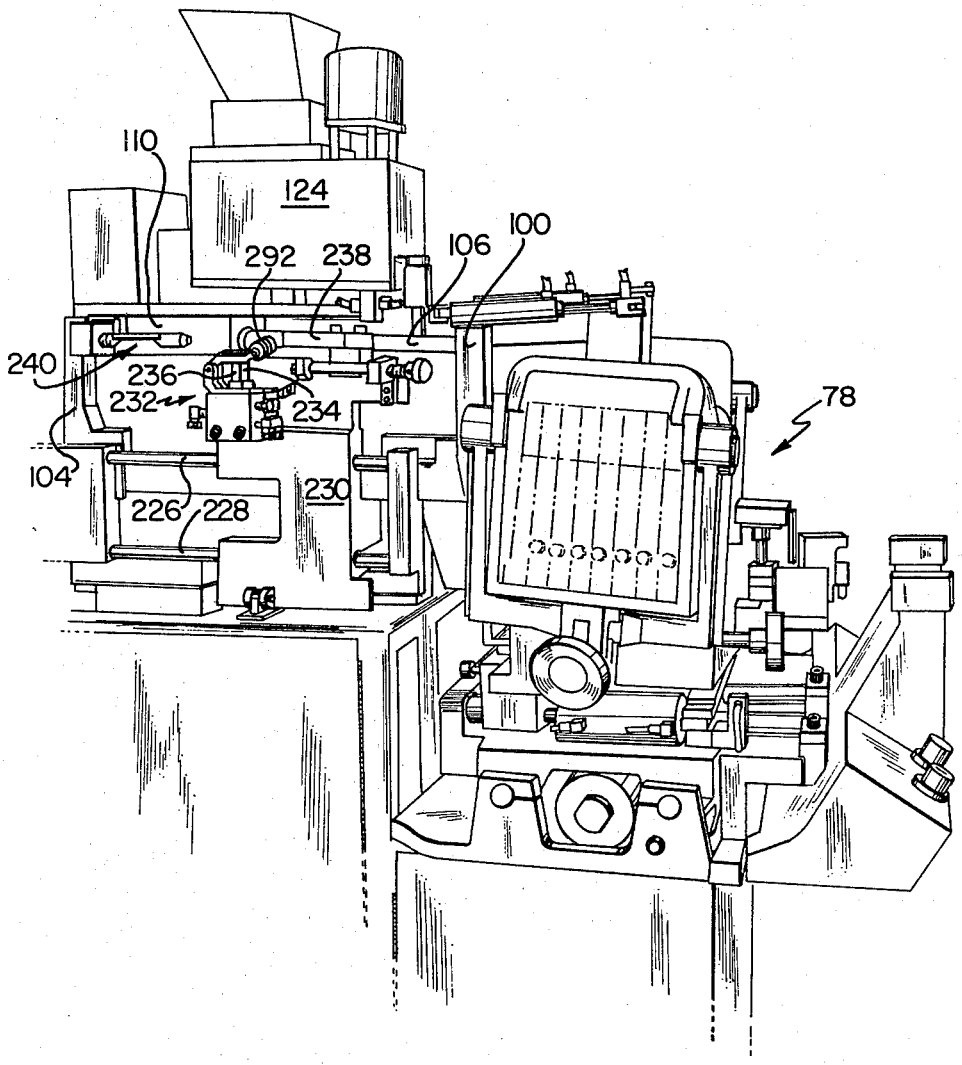

The operator is intended to stand in front of the machine as seen in FIG. 1, to the left of the machine as seen in FIG. 2, and to the right of the machine as seen in FIG. 3. Directions extending toward the operator will be designated as "forward" and directions extending away from the operator will be designated as "rearward". The front of the machine is closest to the operator and the back of the machine is furthermost from the operator.

Figure 4:
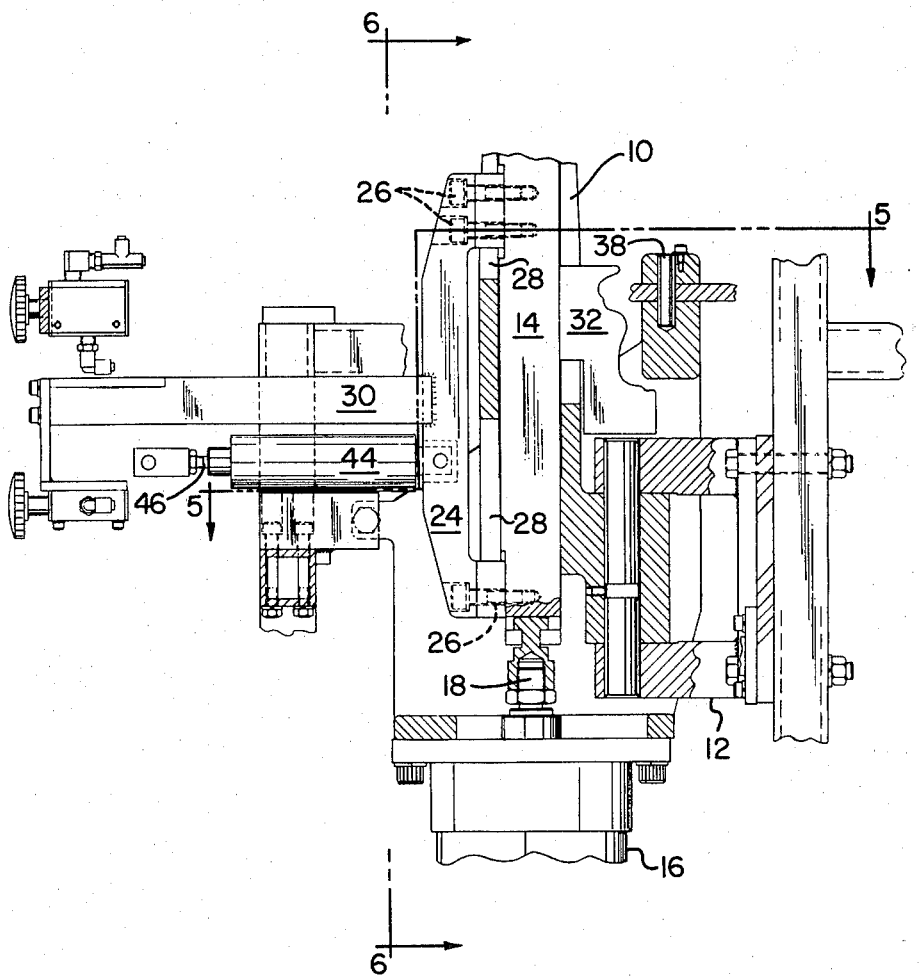
FIG. 4 is a partially sectional elevation view of a mounting of the shoe assembly support.
Figure 5:
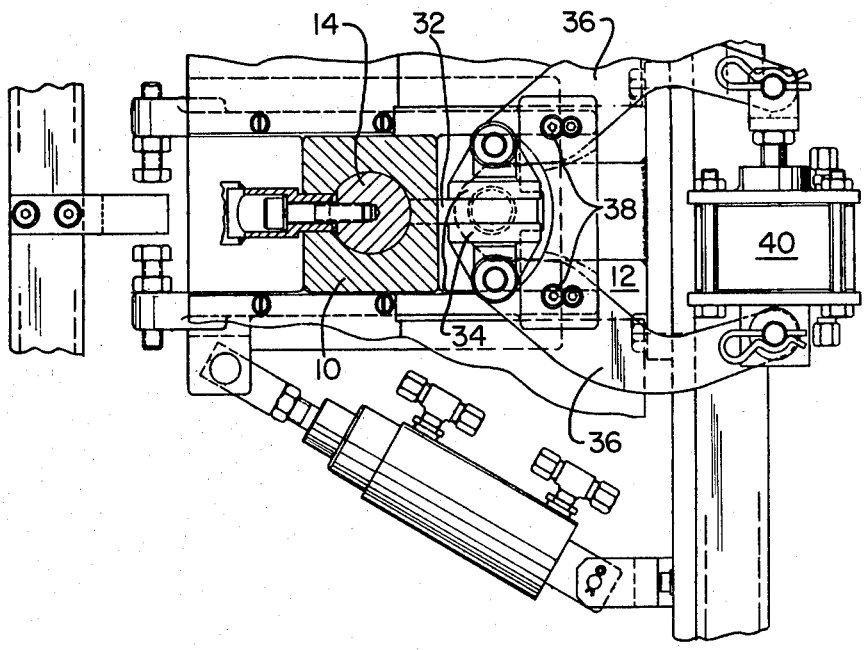
FIGS. 5 and 6 are views respectively taken along the lines 5—5 and 6—6 of FIG. 4.
Figure 6:
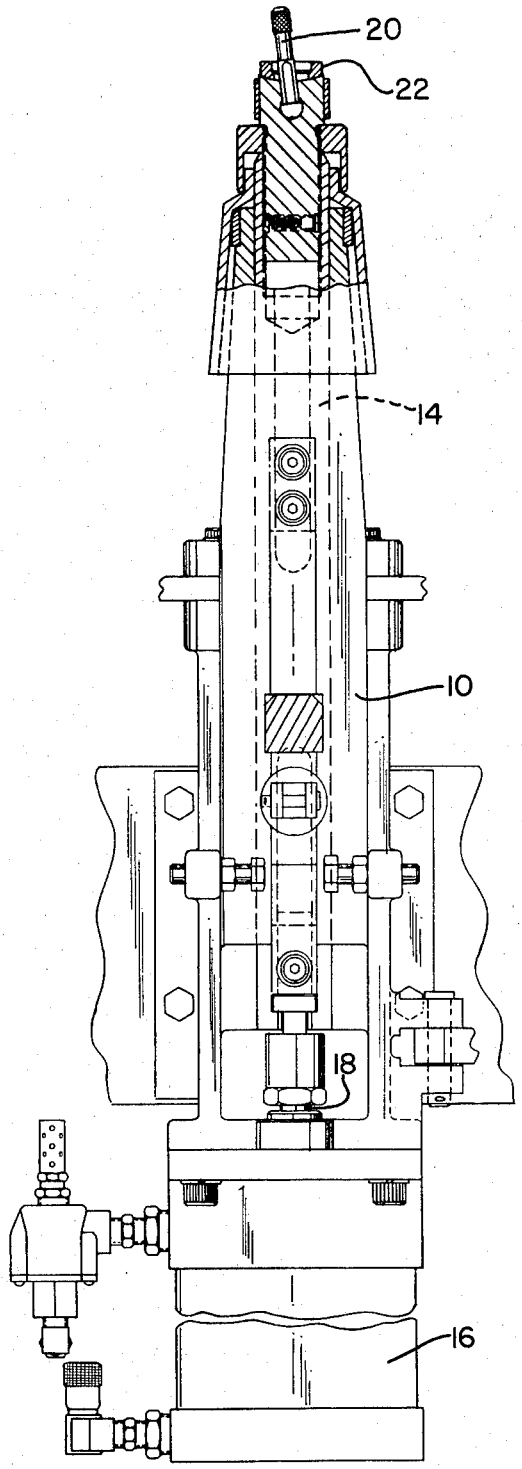

Referring to FIGS. 4-6, the machine includes a sleeve 10 that is mounted to a bracket 12. A bar 14 is mounted in the sleeve 10 for heightwise movement. An air operated motor 16, that is secured to the bracket 12, has an upwardly facing piston rod 18 that is secured to the bottom of the bar 14, whereby the motor 16 can effect heightwise movement of the bar 14. A last pin 20 and a support plate 22 are secured to the top of the bar 14. A flange 24 is affixed to the front of the bar 14 by means of screws 26 that connect the flange 24 and the bar 14 and that extend through slots 28 in the sleeve 10. A strut 30 is secured to and extends forwardly of the flange 24. A brake plate 32 is connected to the bar 14 for heightwise movement therewith and is located between a pair of brake arms 34 that are pivotally mounted on levers 36. The levers 36 are pivoted to the bracket 12 by means of pins 38. The back end of one of the levers 36 is pivotally connected to the piston rod of an air actuated motor 40 and the back end of the other lever 36 is pivotally connected to the cylinder of the motor 40.

Figure 7:
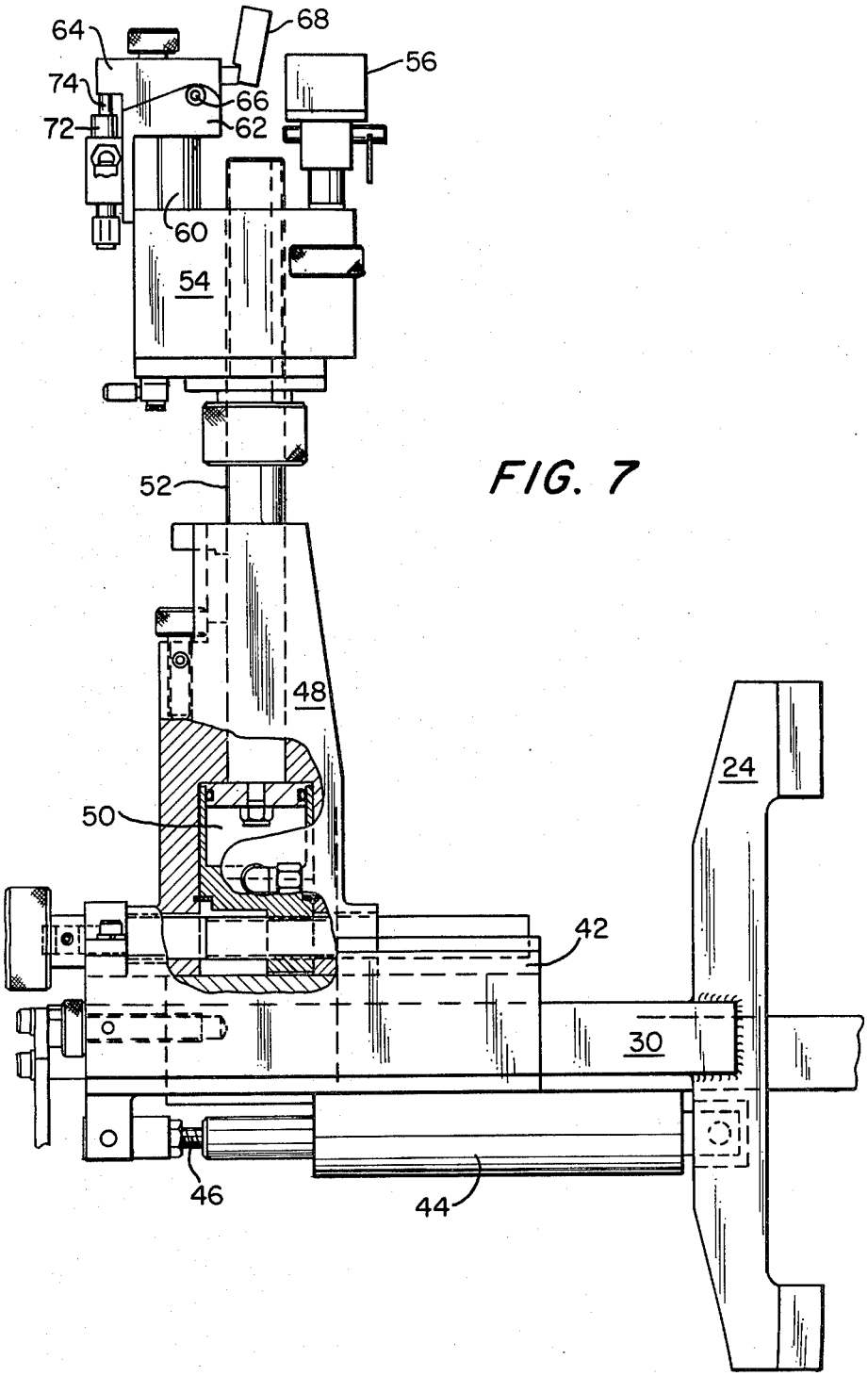
FIG. 7 is a partially sectional elevation of a toe rest-detector member assembly and the mounting therefor.
Figure 8:
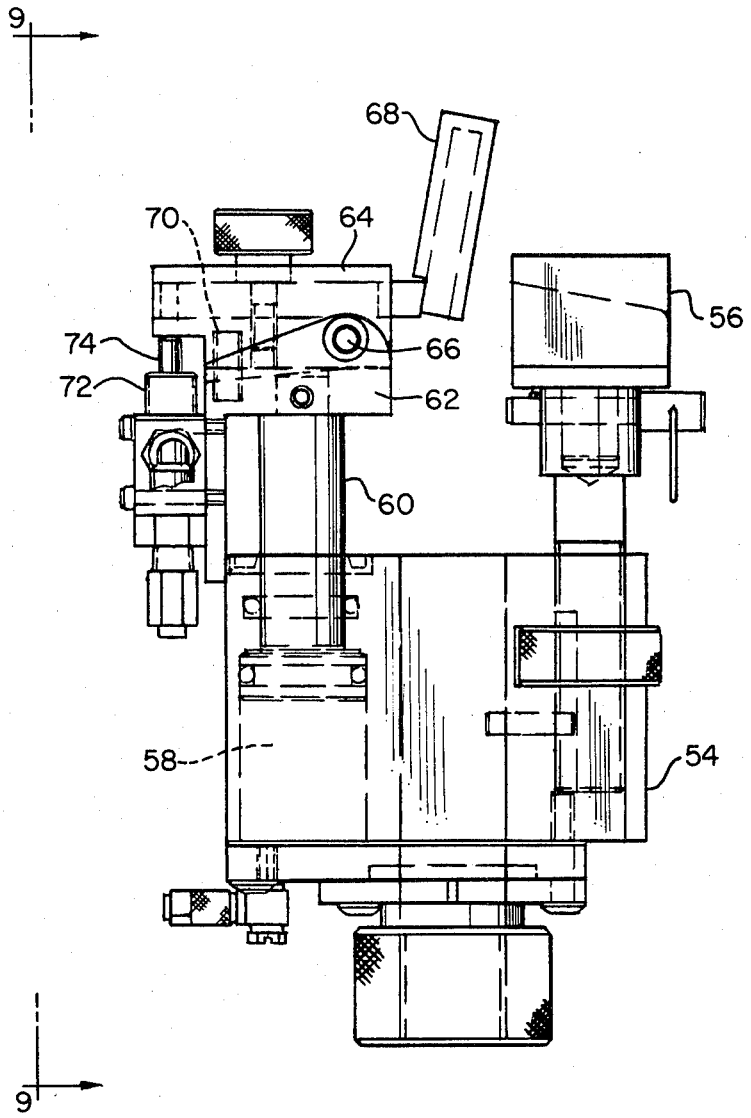
FIG. 8 is an elevation of the toe rest-detector member assembly.
Figure 9:
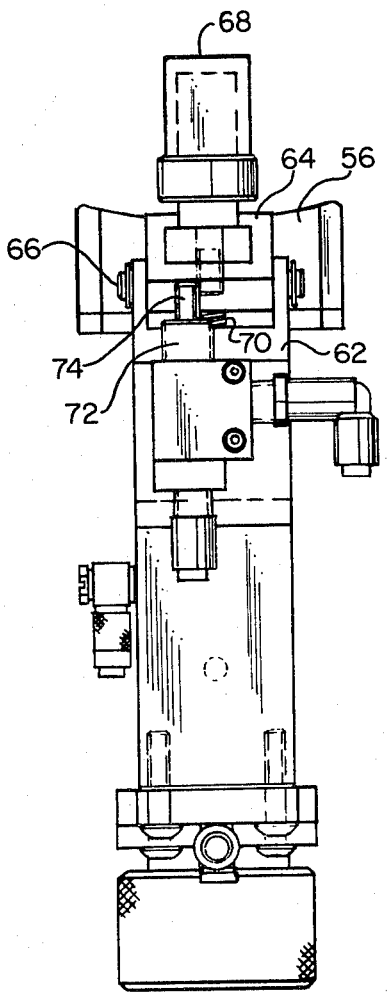
FIG. 9 is a view taken along the line 9—9 of FIG. 8.

Referring to FIGS. 7-9, a housing 42 is slidably mounted to the strut 30 for forward-rearward movement. An air operated motor 44, mounted to the flange 24, has a forwardly directed piston rod 46 that is connected to the housing 42. A column 48, extending upwardly of the housing 42, has an air operated motor 50 formed therein. The motor 50 has an upwardly directed piston rod 52 that is secured to a bracket 54. A toe rest 56 is secured to and extends upwardly of the bracket 54. An air operated motor 58, formed in the bracket 54, has an upwardly directed piston rod 60 and a clevis 62 is secured to the top of the piston rod 60. An arm 64 is pivoted to the clevis 62 by a pin 66 for swinging movement about the horizontal axis of the pin 66 in a vertical plane that lies at right angles to the transverse axis of the pin 66. A detector member or finger 68 is so mounted to the arm 64 as to extend upwardly of the back of the arm 64 forwardly of the toe rest 56. A compression spring 70, interposed between the fronts of the clevis 62 and the arm 64, yieldably urges the arm 64 clockwise (FIG. 8) about the axis of the pin 66 to thereby yieldably urge the finger 68 rearwardly about this axis to a position wherein the bottom of the back of the arm 64 abuts the clevis 62. A valve 72, mounted to the front of the bracket 54, has an upwardly directed valve spool 74 that is resiliently urged upwardly by a conventional spring in the valve 72 into engagement with the front of the arm 64.

The last pin 20, the support plate 22 and the toe rest 56 constitute a shoe assembly support 76 (see FIG. 1).

Duplicate side lasting untis 78 (FIGS. 1–3) are located on opposite sides of the shoe assembly support 76. The side lasting units 76 are constructed as shown in U.S. Pat. No. 4,820,060.

Referring to FIGS. 2, 3 and 10–13, a head 80 is located rearwardly of the last pin 20 and the lasting units 78. A main slide plate 82 is slidably mounted in the head 80 for forward-rearward movement in the manner shown in U.S. Pat. No. 3,963,840. A fluid actuated motor 84, mounted to the head 80, has a piston rod 86 connected to a bracket 88 mounted to the main slide plate 82 to effect forward-rearward movement of the main slide plate 82. In the manner shown in U.S. Pat. No. 3,963,840, a forwardly facing heel clamp 90 and forwardly facing heel wipers 92 are movably mounted to the main slide plate 82 with the heel wipers 92 being located above the heel clamp 90. A hold-down 94 is movably mounted to a cover 96 of the main slide plate 82 for forward-rearward movement and for heightwise movement in the manner shown in U.S. Pat. No. 3,963,840.

Referring to FIGS. 1–3, 10 and 11, a pair of front posts 98 and 100 and a pair of back posts 102 and 104 are upstanding from the head 80. The two front posts and the two back posts are located on opposite sides of the head 80 and a slide rod 106 extends between the posts 98 and 102 and between the posts 100 and 104 so as to be located on opposite sides of the head 80 and so as to extend in forward-rearward directions. A bearing block 108 is slidably mounted on one of the rods 106 and a bearing block 110 is slidably mounted on the other of the rods 106. A plate 112 extends between the slide rods 106 and is secured to the bearing blocks 108, 110, the plate 112 thus being mounted for forward-rearward movement. A lug 114, that is upstanding from a bracket 116 secured to the head 80, has an air operated motor 118 pivoted thereto. The motor 118 has a forwardly directed piston rod 120 that is mounted to a prong 122 depending from the front of the plate 112, whereby the motor 118 effects forward-rearward movement of the plate 112 and the parts, described below, mounted thereto.

A cement extruding mechanism 124 (FIGS. 1–3), shown in greater detail in U.S. Pat. No. 4,082,060, is mounted to the slide plate 112 for forward-rearward movement therewith. The cement extruding mechanism 124 includes a post 126 (FIG. 11) that is seated in a block 128 that is swingably mounted on the post.

Figure 10:
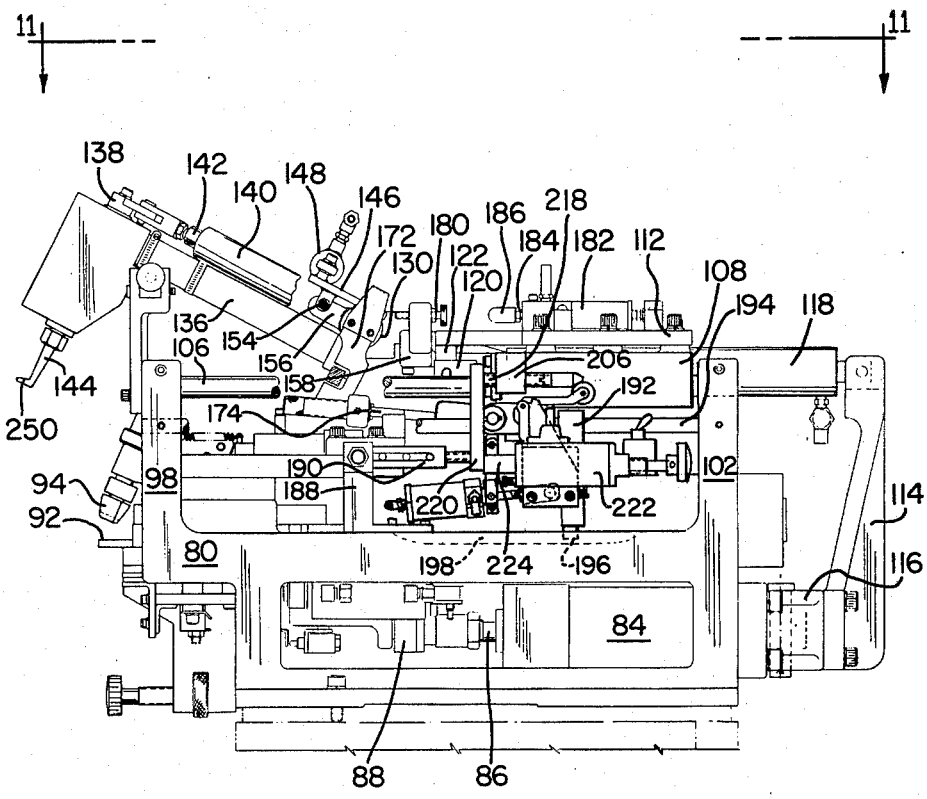
FIG. 10 is a side elevation of a portion of the machine showing instrumentalities operating on the heel portion of the shoe assembly and cement applying nozzles.
Figure 11:
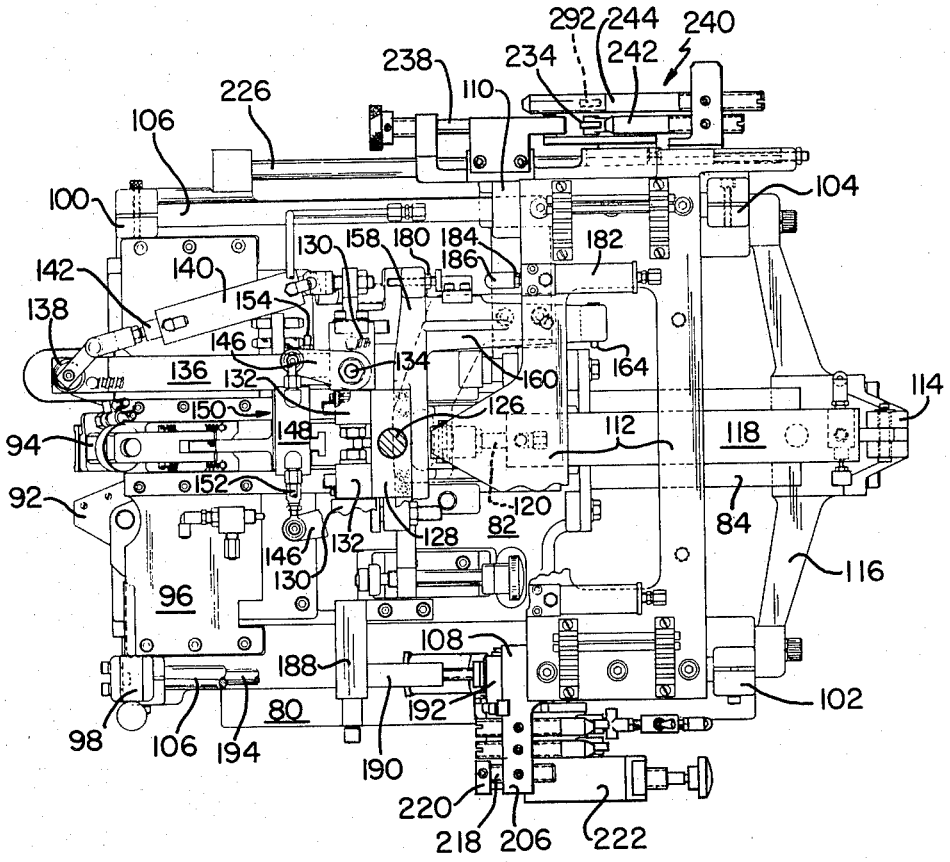
FIG. 11 is a view taken along the line 11—11 of FIG. 10.

Referring to FIGS. 10 and 11, a pair of spindles 130 are rotatably mounted in extensions 132 of the block 128 for swinging movement about a horizontal axis and a heightwise extending spindle 134 is rotatably mounted in each spindle 130 for swinging movement about a heightwise extending axis in the manner shown in U.S. Pat. No. 3,963,840. A nozzle carrier 136 is mounted to each spindle 134 so as to extend forwardly thereof and a nozzle holder 138 is pivotally mounted to the front of each nozzle carrier 136 for swinging movement about a heightwise extending axis. An air actuated motor 140, mounted to each spindle 130, has a forwardly directed piston rod 142 that is pivotally connected to each nozzle holder 138 to effect swinging movement of its associated nozzle holder 138 about its heightwise extending axis. A nozzle 144 is mounted to and extends downwardly of each nozzle holder 138. Interconnected passages, not shown, provide communication between the cement extruding mechanism 124 and the nozzle 144 as more fully disclosed in U.S. Pat. No. 4,082,060 and in U.S. Pat. Nos. 3,901,181 and 3,963,840. Strategically located electric heaters, not shown, serve to maintain the cement in these passages molten. An arm 146 extends radially from each spindle 134. One of the arms 146 is connected to the cylinder 148 of an air operated motor 150 and the other arm 146 is connected to the piston rod 152 of the motor 150 whereby the motor 150 may effect rotation of the spindles 134 in the spindles 130 and thereby effect inward and outward movements of the nozzles 144. The extent of inward movement of the nozzles 144 is determined by the engagement of stop bolts 154 mounted to the arms 146 with lugs 156 that are mounted to the spindles 130.

Referring to FIGS. 10, 11 and 14–16, a frame 158 is attached to the block 128. Flanges 160 extend rearwardly of the frame 158 on each side of the frame 158 and an air operated motor 162 is pivoted to the back of each flange 160 by a pivot pin 164. The forwardly directed piston rod 166 of each motor 162 is secured to a clevis 168. Each clevis 168 is pivoted by a pin 170 to a lug 172 that depends from one of the spindles 130. A rearwardly facing plunger 174 is secured to each clevis 168 and a valve 176 is secured to each flange 160. The stem 178 of each valve 176 is located rearwardly of and is registry with its associated plunger 174. The motors 162 can thus be seen to effect swinging movement of the spindles 130 in the block extensions 132 and thereby effect heightwise movement of the nozzle 144. A stabilizer bolt 180 (FIGS. 10 and 11) is mounted to and extends rearwardly of each side of the frame 158. A spring return air operated motor 182, mounted to each side of the plate 112, has a forwardly directed piston rod 184 that is in registry with its associated stabilizer bolt 180. Each piston rod 184 has a head 186 mounted thereon that is adapted to engage its associated bolt 180 in the manner described below.

Referring to FIGS. 2, 10 and 11, a brace 188 is anchored to the main slide plate 82 as shown in greater detail in U.S. Pat. No. 4,082,060. A mount 190 is secured to the brace 188 and a housing 192 is secured to the mount 190. The housing 192 is slidably mounted on a rod 194 that extends between the posts 98 and 102 and the bottom of the housing 192 has a roll 196 fixed thereto that is slidably received in a cut out 198 in the head 80, thus enabling the housing 192 to partake of the forward-rearward movement of the main slide plate 82.

A strut 206 is mounted to the bearing block 108. A bolt 281 is mounted to the strut 206 and a post 220 is mounted to and extends downwardly of the bolt 218. An air operated motor 222, constructed similarly to the air actuated motor 282 of U.S. Pat. No. 4,082,060, is so mounted to the housing 192 as to have its piston rod 224 directed forwardly towards the post 220.

Figure 17:
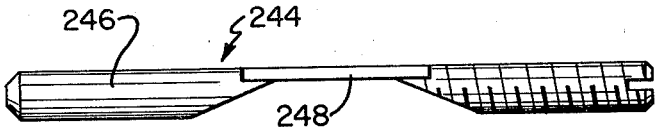
FIG. 17 is a view of a cam which functions as the actuating member.
Figure 15:
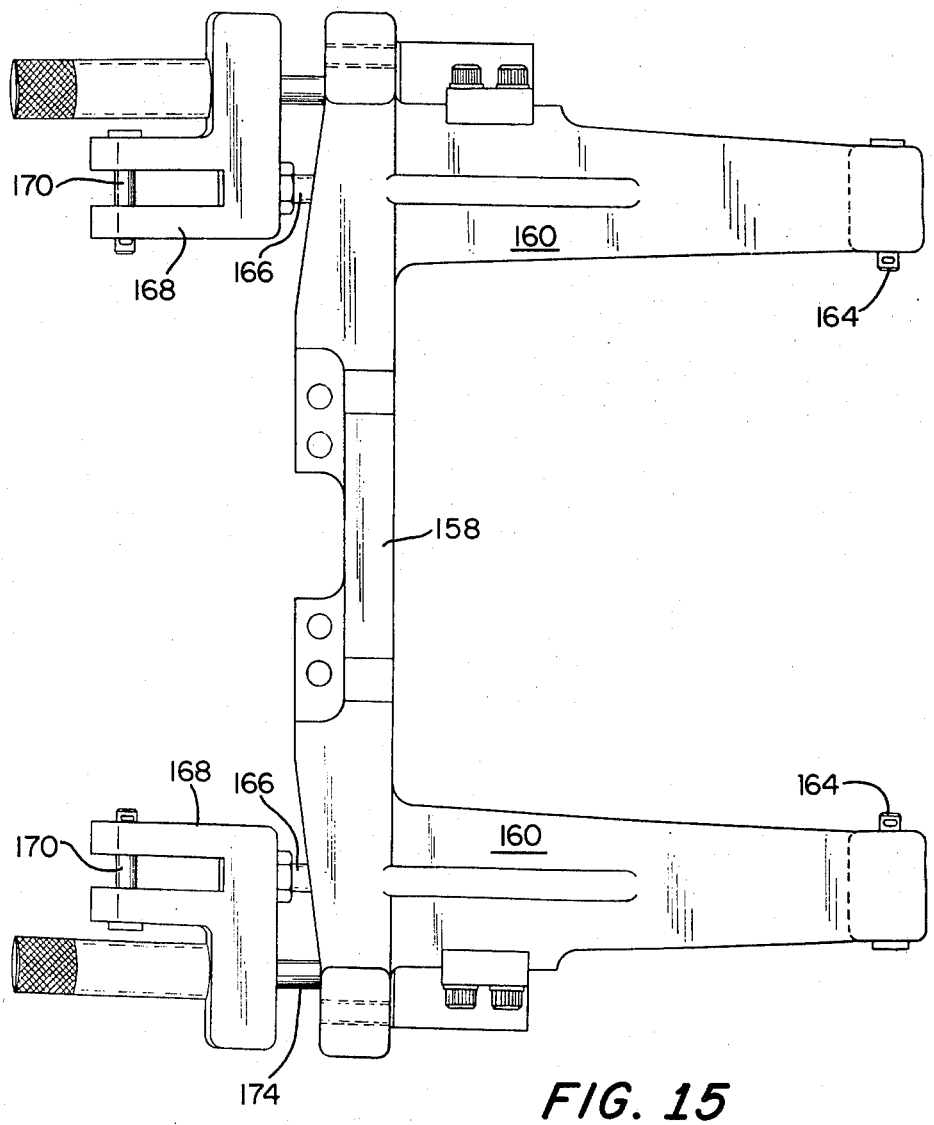

Referring to FIGS. 3 and 11, a pair of vertically spaced rods 226 and 228 are so mounted to the head 80 as to be below and outwardly offset from the rod 106 extending between the posts 100 and 104. A housing 230 is slidably mounted on the rods 226, 228 for forward-rearward movement. A valve bank 232, containing two side by side valves 234 and 236, is mounted to the housing 230 for forward-rearward adjustment. A rearwardly facing stop rod 238 is so mounted to the housing 230 as to be in registry with and forward of the valve 234. A cam bank 240 is mounted to the bearing block 110 for forward-rearward movement therewith. The cam bank 240 contains two forwardly directed cams 242 and 244 that are respectively in registry with the valves 234 and 236. The cam 244 extends further forwardly than the cam 242. Referring to FIG. 17, the cam 244 has a front segment 246 and a back segment 248 with the bottom of the front segment 246 being at a lower elevation than the bottom of the back segment 248.

The housings 42 and 230 are connected to each other for unitary forward-rearward movements in the same manner as the housings 30 and 266 of U.S. Pat. No. 4,082,060 whereby the motor 44 effects concurrent forward-rearward movements of the housings 42 and 230. A housing brake coacts with the housing 230 to lock the housing 230 in a forward-rearward position on the rods 226 and 228 in the same manner as the housing brake formed of the brake rods 306 coacts with the housing 266 as disclosed in U.S. Pat. No. 4,082,060.

In the idle condition of the machine: the piston rod 18 is retracted into the motor 16 to maintain the shoe assembly support 76 in a lower position; the motor 40 is so actuated as to cause the brake arms 34 to be spaced from the brake plate 32; the piston rod 46 is projected out of the motor 44 to maintain the toe rest 56, the finger 68, and the housing 230 together with the valve bank 232 and the stop rod 238 carried by the housing 230 in forward positions; the motor 50 causes the piston rod 52 to move upwardly to thereby resiliently urge the toe rest 56 upwardly under the force of pressurized air in the motor 50; the piston rod 60 is projected out of the motor 58 to maintain the finger 68 in an upper position with respect to the toe rest 56 with the finger upwardly of the toe rest; the piston rod 86 is retracted into the motor 84 to maintain the main slide plate 82, and the heel clamp 90 and the heel wipers 92 carried by the main slide plate 82, in rearward positions; the piston rod 120 is retracted into the motor 118 under relatively low pressure to thereby locate the plate 112 and the parts carried thereby, including the nozzles 144, in a rearward position with the post 220 in engagement with the piston rod 224; the piston rods 142 are retracted into the motors 140 so that the tips 250 (FIG. 10) at the bottoms of the nozzles 144 point rearwardly substantially parallel to the longitudinal center line of the machine; the piston rod 152 is retracted into the cylinder 148 of the motor 150 so that the nozzles 144 are swung inwardly about the axes of the spindles 134 to the extent permitted by the engagement of the stop bolts 154 with the lugs 156 to positions that are relatively close to each other; the piston rods 166 are projected out of the motors 162 to thereby move the nozzles 144 about the axis of the spindles 130 to raised positions; the piston rods 184 are projecting out of the motors 182 with the heads 186 bearing against the stabilizer bolts 180 so that the block 128, together with the nozzles 144, is restrained against movement about the upright axis of the post 126; the piston rod 224 is projected to its greatest extent forwardly of the motor 222; the cam bank 240 is located rearwardly of and out of engagement with the valve bank 232; and the housing brake is in open position so as to permit the housing 230 to move along the rods 226 and 228.

In the manner disclosed in U.S. Pat. No. 4,082,060, the cement extruding mechanism 124 is charged with molten cement which flows up to valves in each nozzle holder 138 that are similar to the valves in the nozzle holders shown in U.S. Pat. No. 3,901,181.

Figure 21:
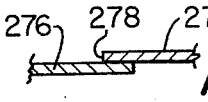
FIG. 21 is a section taken along the line 22-21 of FIG. 18.
Figure 20:
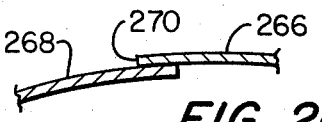
FIG. 20 is a section taken along the line 20—20 of FIG. 19.

A shoe assembly 252 (FIGS. 18 and 19) comprising a last 254 having an insole 256 located on its bottom and an upper 258 mounted thereon is placed bottom-up on the shoe assembly support 76 with the vamp of the shoe assembly resting on the toe rest 56, with the back cone 260 of the last resting on the support plate 22 and with the last pin 20 inserted into the thimble 262 in the heel portion of the last so that the toe of the shoe assembly faces forwardly. The heel seat portion 264 of the insole 256 lies substantially in a horizontal plane, the shank portion 266 of the insole 256 inclines forwardly and upwardly, and the forepart portion 268 of the insole 256 inclines forwardly and downwardly. As shown in FIG. 20, the insole forepart portion 268 and the insole shank portion 266 are so connected to each other as to form an upstanding ridge 270 that faces forwardly. As shown in FIG. 21, the side portions 272 of the upper 258 are formed of two segments 274 and 276 that are stitched to each other in such a manner as to form inwardly extending ridges 278 that face forwardly. Prior to placement in the machine, the shoe assembly 252 had been toe lasted so that the toe portion 280 (see FIG. 19) of the upper margin had been wiped against and attached to the insole 256. At this time, the detector finger 68 is located forwardly of the toe end extremity of the shoe assembly 252 an amount that is dependent on the length of the shoe assembly 252 and that is also dependent on the distance between the thimble 262 and the toe end extremity of the shoe assembly.

Figure 18:
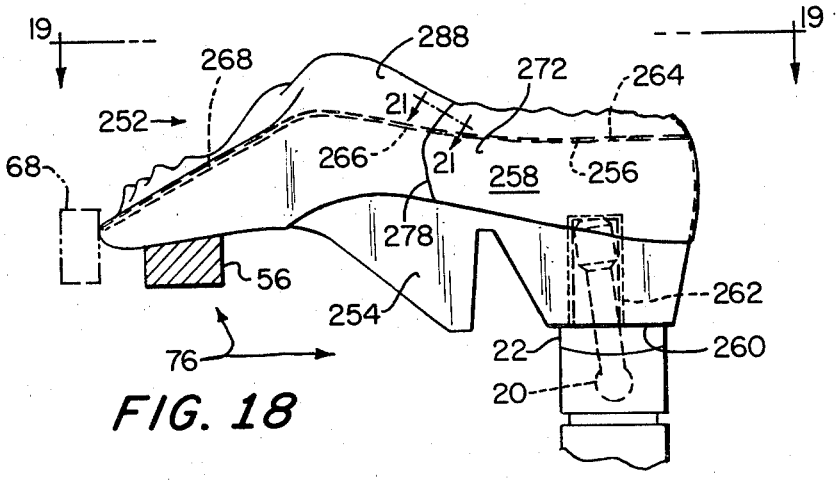
FIG. 18 is a side view of the shoe assembly as it appears in the machine at the beginning of a machine cycle.
Figure 19:
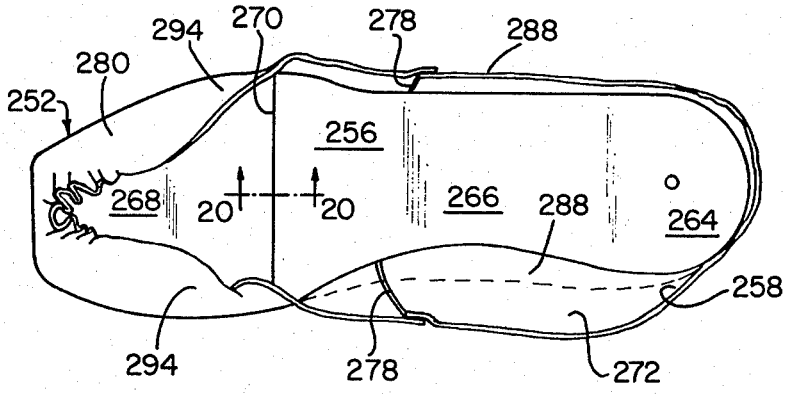
FIG. 19 is a view taken along the line 19—19 of FIG. 18.

Pursuant to the placement of the shoe assembly 252 on the shoe assembly support 76, the motor 44 is so actuated as to retract its piston rod 46 rearwardly under the yieldable force of pressurized air to thereby yieldably move the bracket 54, together with the toe rest 56 and the detector finger 68, rearwardly with the toe rest sliding under the shoe assembly vamp until this rearward movement is terminated by the engagement of the detector finger 68 with the toe end extremity of the shoe assembly 252 as indicated in FIG. 18. The connector between housings 42 and 230 enables the housing 230, together with the valve bank 232 and the stop rod 238, to move rearwardly on the rods 226 and 228 in unison with the rearward movement of the bracket 54.

Figure 23:
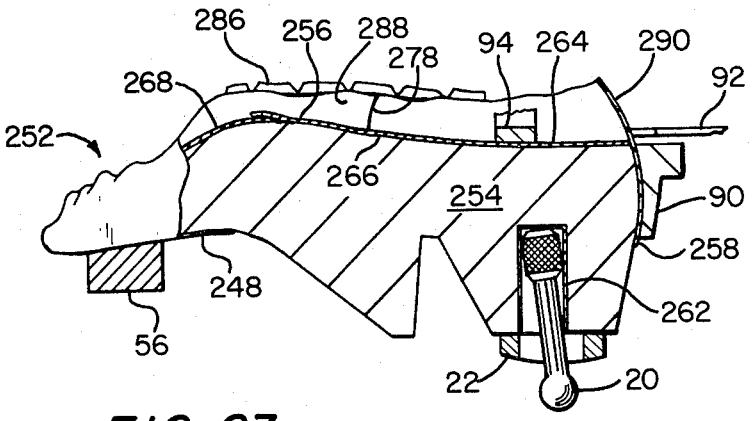
FIG. 23 is a section taken along the line 23—23 of FIG. 22.
Figure 22:
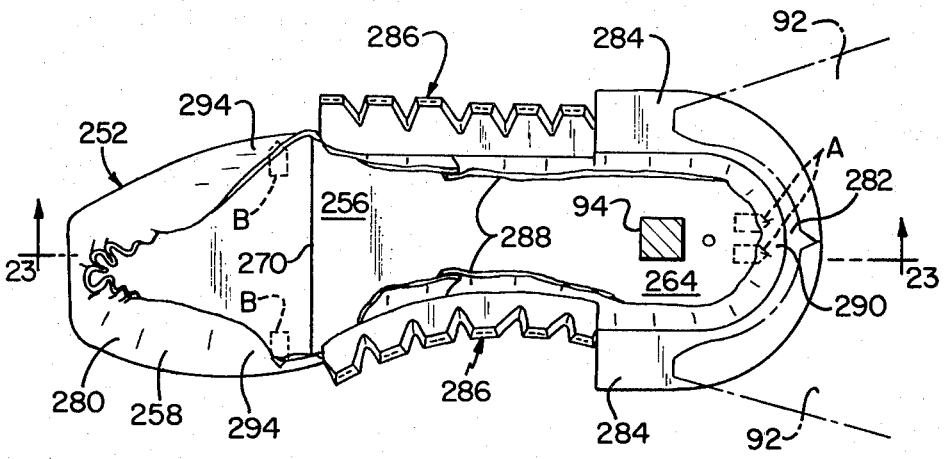
FIG. 22 is a plan view of the shoe assembly as it appears in the machine after the side and the heel portions of the upper have been clamped to the last.

In response to the engagement of the detector finger 68 with the toe end of the shoe assembly, the detector finger is swung counterclockwise (FIG. 8) about the axis of the pin 66 to thereby cause the arm 64 to engage and shift the valve spool 74 of the valve 72. In response to this shifting of the valve 72, the hold-down 94 is caused to move forwardly over the heel portion of the shoe assembly 252 and to be lowered to a position wherein its bottom is at substantially the same elevation as the plane of the bottoms of the heel wipers 92 in the manner shown in U.S. Pat. No. 3,963,840. This is followed by an actuation of the motor 16 to project its piston rod 18 upwardly to thereby raise the bar 14, together with the shoe assembly support 76 and the detector finger 68, until the insole heel seat portion 264 bears against the bottom of the hold-down 94, as shown in FIGS. 22 and 23, to thus locate the insole heel seat portion 264 in a plane substantially level with the plane of the bottoms of the heel wipers 92 in a plane substantially parallel to the plane of movement of the heel wipers 92.

Pursuant to the raising of the bar 14 and the bearing of the insole heel seat portion 264 against the bottom of the hold-down 94, the motor 40 is actuated to force the brake arms 34 against the brake plate 32 to thereby lock the bar 14 and the shoe assembly support 76 in their raised positions.

Also pursuant to the raising of the bar 14 and the bearing of the insole heel seat portion 264 against the bottom of the hold-down 94, the motor 44 is actuated to relieve the rearwardly directed movement of its piston rod 46 and thus relieve the rearwardly directed force applied by the detector finger 68 against the toe end of the shoe assembly 252 and the motor 58 is actuated to lower its piston rod 60 and thereby lower the detector finger 68 out of engagement with the toe end of the shoe assembly 252. The relieving of the rearwardly directed force of the detector finger 68 against the toe end of the shoe assembly 252 enables the detector finger to move downwardly without snubbing or being caught on the toe end of the shoe assembly. However, due to inertia and the yieldably directed pressure applied by the toe rest 56 against the vamp of the shoe assembly 252 by the motor 50, there is no significant forward-rearward shifting of the bracket 54 and the housing 230 when the rearwardly directed movement of the piston rod 46 is relieved.

Figure 13:
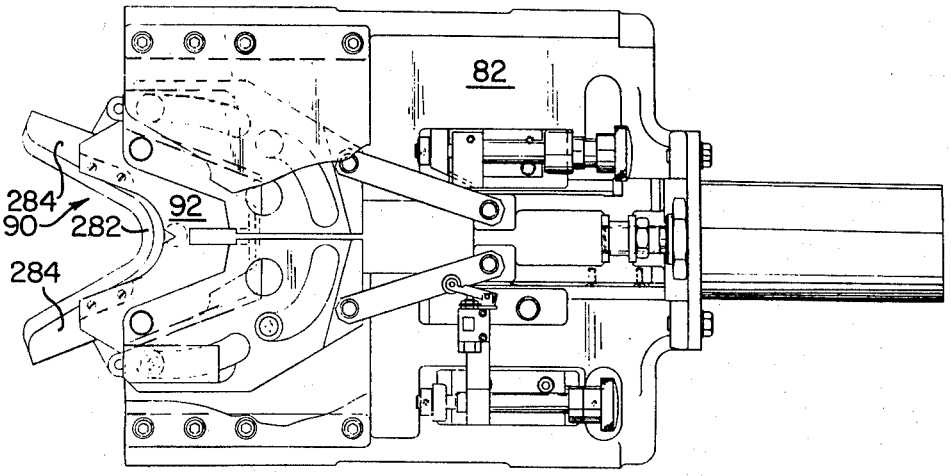
FIG. 13 is a view taken along the line 13—13 of FIG. 12.
Figure 12:
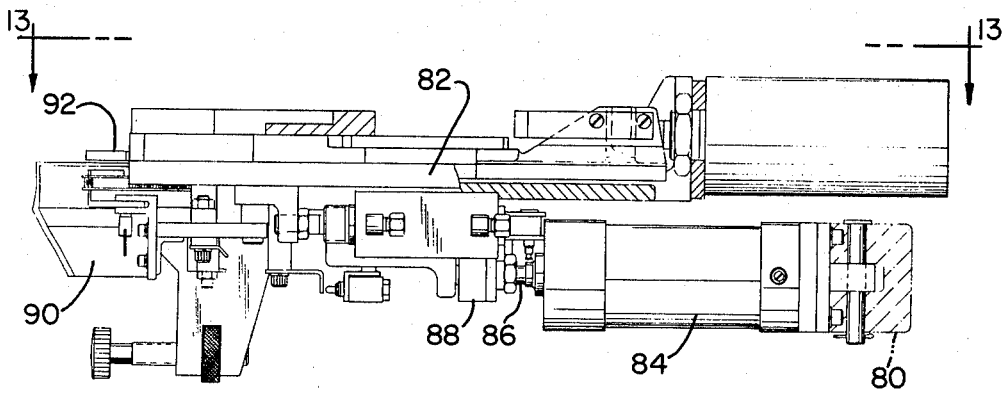
FIG. 12 is a side elevation showing instrumentalities operating on the heel portion of the shoe assembly and drive mechanisms therefor.
Figure 14:
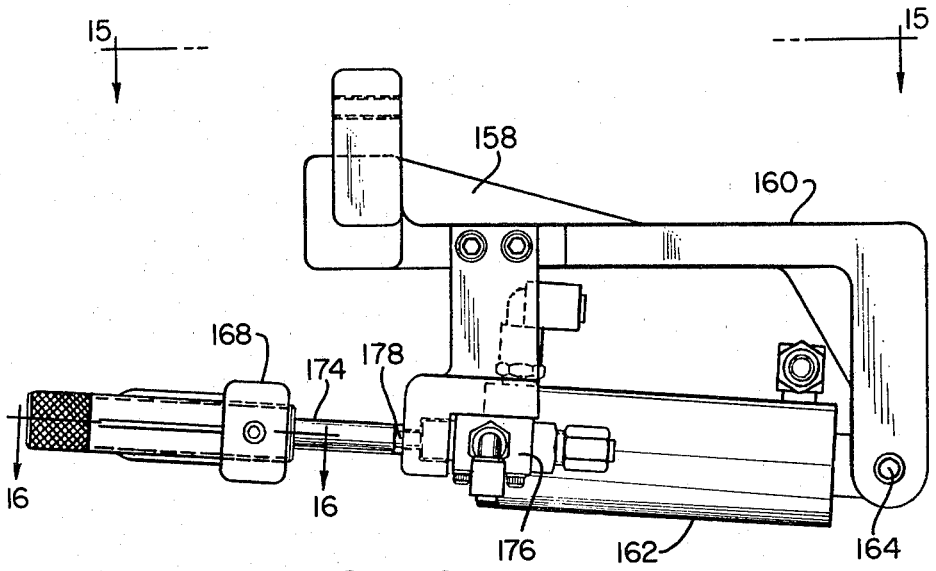
FIG. 14 is a side elevation of a nozzle raising and lowering mechanism.
Figure 16:
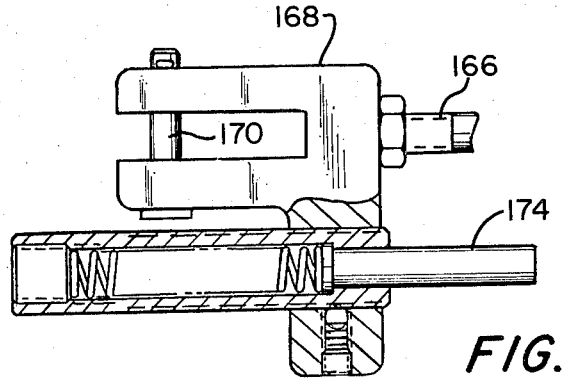
FIGS. 15 and 16 are respectively views taken along the lines 15—15 and 16—16 of FIG. 14.

Also, pursuant to the raising of the bar 14 and the bearing of the insole heel seat portion 264 against the bottom of the hold-down 94, the motor 84 is actuated to move its piston rod 86 forwardly to thereby move the main slide plate 82 forwardly. As shown in FIG. 13, the heel clamp 90 has a bight 282 and a pair of legs 284 extending forwardly and divergently from the bight. In the idle position of the machine, the heel clamp 90 is held in an open position with the legs 284 spaced relatively far apart by the mechanism shown in U.S. Pat. No. 3,963,840. The forward movement of the main slide plate 82 causes concurrent forward movement of the heel clamp 90 and the heel wipers 92. The forward movement of the main slide plate 82, due to the engagement of the post 220 with the piston rod 224, causes the plate 112 and the parts mounted to the plate 112 including the nozzles 144 to concurrently move forwardly overcoming the relatively low pressure of the motor 118 yieldably urging the plate 112 rearwardly. This forward movement of the main slide plate 82 is terminated in response to the engagement of the clamp bight 282 with the heel end extremity of the shoe assembly 252 by the mechanism disclosed in U.S. Pat. No. 3,963,840 to thereby position the heel clamp 90 in a clamping position and the heel wipers 92 in a position of readiness for wiping in a desired relationship with the heel end of the shoe assembly 252 regardless of the location of the heel end of the shoe assembly, the location of the heel end of the shoe assembly being dependent on the forward-rearward distance between the thimble 262 and the heel end of the shoe assembly. By the mechanism shown in U.S. Pat. No. 3,963,840, in response to the engagement of the clamp bight 282 with the heel end of the shoe assembly 252, the clamp legs 284 are caused to move inwardly to clamp the sides of the heel end of the shoe assembly to thereby enable the clamp 90 to clamp the entire heel end of the shoe assembly as shown in FIG. 22.

The side lasting units 78 comprise side lasting instrumentalities 286 which are now, in the manner described in U.S. Pat. No. 4,082,060, caused to press the side portions of the upper 258 against the sides of the last 254. The shoe assembly engaging parts are now in the positions shown in FIGS. 22 and 23 with the heel clamp 90 pressing the heel portion of the upper 258 against the last 254 and the side lasting instrumentalities 286 pressing the side portions of the upper against the last in such manners that the side portions 288 and the heel portion 290 of the upper margin are extending upwardly of the insole 256 and are folded part way towards the insole.

Concurrently with the pressing of the side portions of the upper 258 against the last by the side lasting instrumentalities 286, the housing brake locks the housing 230, the valve bank 232 and the stop rod 238 in the positions they had assumed pursuant to the engagement of the detector finger 68 with the toe end extremity of the shoe assembly 252.

Now the hold-down 94 is raised from the shoe assembly 252 and is moved rearwardly to its idle position away from the shoe assembly in the manner shown in U.S. Pat. No. 3,963,840 to prevent interferences between the hold-down and the nozzles 144 during the below described forward cement applying movements of the nozzles. The heightwise position of the shoe assembly 252 is not affected by the disengagement of the hold-down 94 from the shoe assembly due to the aforementioned locking of the bar 14 against heightwise movement by the actuation of the motor 40.

Now the piston rods 162 are retracted into the motors 166 under the yieldable force of pressurized air to cause the nozzles 144 to descend and engage the insole heel seat portion 264. The heel clamp bight 282, the post 220, and the piston rod 224 are so related to each other that the nozzles 144 engage the insole just forwardly of the folded heel end extremity of the heel portion 290 of the upper margin as indicated by position A in FIG. 22. The lowering of the nozzles 144 causes the plungers 174 to shift the valves 176. The shifting of the valves 176 shuts off the flow of pressurized air to the motors 182 so that the return springs of these motors retract the heads 186 out of engagement with the stabilizer bolts 180 to thereby enable the motor 150 to move the nozzles 144 outwardly. This is followed by an actuation of the motor 222 to retract its piston rod 224 rearwardly a prescribed amount similarly to the retraction of the piston rod 284 into the motor 282 in U.S. Pat. No. 4,082,060. Due to the piston rod 120 being urged rearwardly into the motor 118 under relatively low pressure at this time, this retraction of the piston rod 284 causes the post 220 to move rearwardly with the piston rod 224 and thus causes rearward movement of the plate 112 and the nozzles 144 an amount equal to said prescribed amount of retraction of the piston rod 224 to thereby move the nozzles 144 rearwardly under the folded heel portion 290 of the upper margin with the nozzle tips 250 pointing towards and closely adjacent to the heel end extremity of the upper margin.

Figure 24:
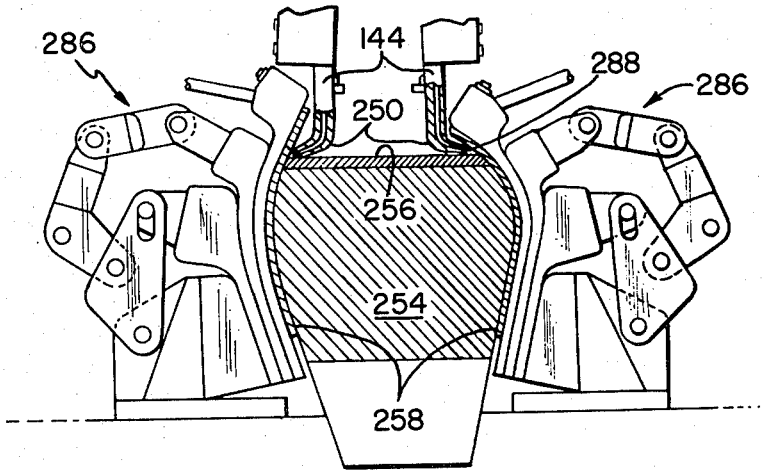
FIG. 24 is a view showing the nozzle as it appears during the cement applying stroke.

After the nozzles 144 have been located so that the nozzle tips 250 point towards and are closely adjacent to the heel end extremity of the upper margin, the piston rods 142 are projected out of the motors 140 so as to swing the nozzles 144 forwardly and outwardly about their heightwise extending axes approximately through arcs of about 110 degrees to positions wherein the nozzle tips 250 project outwardly and laterally of the heel-toe axis of the shoe assembly 252 as indicated in FIG. 24. At about the same time, the motor 150 is so actuated as to project the piston rod 152 out of the cylinder 148 to thereby swing the nozzles 144 outwardly under the yieldable forces of pressurized air about the axes of the spindles 134 to the extent permitted by the engagements of the nozzle tips 250 with the upper margin (see FIG. 24). At about the same time, the motor 118 is so actuated as to project its piston rod 120 forwardly to thereby move the plate 112 and the nozzles forwardly. At the same time, the cement extruding mechanism 124 is actuated, in the manner shown in U.S. Pat. No. 4,082,060, to force cement out of the nozzle tips 250 into the angle between the upper margin and the insole. As a result, the nozzles 144 move forwardly and toewardly in cement applying strokes from the heel end extremity of the shoe assembly 252 into the corner between the upper margin and the insole while the nozzles are urged downwardly against the insole and outwardly against the upper margin while cement is extruded from the nozzle tips 250 into this corner on the opposite sides of the shoe assembly 252.

The heelward orientation of the nozzle tips 250 at the beginning of the cement applying strokes in close proximity to each other as determined by the engagement of the bolts 154 with the lugs 156 ensures that cement is extruded into the heel end extremity of the corner between the upper margin and the insole at the heel end at the beginning of the cement applying strokes. The outward urging of the nozzles 144 and the orientation of the nozzle tips 250 outwardly and laterally of the heel-toe axis of the shoe assembly shortly after the commencement of the cement applying strokes ensures that the nozzle tips 250 are directed into the corner between the upper margin and the insole when the nozzles are toeward of the heel end extremity of this corner. During the heel to toe movements of the nozzles 144 along this corner, the nozzles will not snag on the forwardly and toewardly facing ridges 270 and 278 as tends to occur when the nozzles move along this corner in toe to heel movements as in U.S. Pat. No. 4,082,060.

Pursuant to the forward movements of the nozzles 144 in their cement applying strokes, the cams 242 and 244 move forwardly and respectively intersect the valves 234 and 236.

The actuator 292 (FIGS. 3 and 11) of the valve 236 is yieldably urged into an upper position by a conventional spring in this valve. The control circuit of the machine is so constituted that, during the cement applying strokes of the nozzles 144, when the valve actuator 292 is in its upper position, the motors 162 yieldably urge the nozzles 144 downwardly against the insole 256 under a prescribed force and when the valve actuator 292 is depressed this prescribed force is relieved, preferably by causing the motors 162 to yieldably urge the nozzles 144 upwardly under a relatively low force such as to offset the gravitational downward force of the nozzles 144 about the axis of the spindles 130 caused by the weights of the nozzles 144, the nozzle holders 138, the nozzle carriers 136, the motors 140 and 148, the arms 146, and the lugs 172. At the beginning of the cement applying strokes when the nozzles are moving along the horizontally disposed insole heel seat portion 264, the cam 244 is rearward of and disengaged from the valve actuator 292 so that the nozzles 144 are yieldably urged downwardly under the prescribed force. The front segment 246 of the cam 244 intersects and depresses the valve actuator 292 at about the time the nozzles 144 reach the boundary between the insole heel seat portion 264 and the forwardly and upwardly inclined insole shank portion 266 so that the prescribed downwardly directed force of the nozzles is relieved during the movement of the nozzles along the insole shank portion 266. The back segment 248 of the cam 244 intersects the valve actuator 292 and enables the valve actuator 292 to rise to its upper position at about the time the nozzles 144 reach the boundary between the insole shank portion 266 and the forwardly and downwardly inclined insole forepart portion 268 so that the prescribed downwardly directed force of the nozzles is again applied to the nozzles during the movement of the nozzles along the insole forepart portion 268. When the nozzles 144 are travelling upwardly along the insole shank portion 266, if the downwardly directed force of the nozzles 144 is not relieved there is an undesired resistance to the forward movement of the nozzles imparted to the nozzles by the motor 118 and there is a tendency of the nozzles to, undesirably, dig into and gouge the insole shank portion 266. When the nozzles 144 are travelling horizontally along the insole heel seat portion 264 and downwardly along the insole forepart portion 268, it is desirable that they have prescribed downwardly directed force imparted to them to enable them to effectively bear against these insole portions during the cement applying strokes.

FIG. 24 shows the relationship of the nozzles 144 to the shoe assembly while the nozzles are moving past the side portions 288 of the upper margin during the cement applying strokes.

The forward movements of the plate 112 and of the nozzles 144 and the cement applying strokes of the nozzles 144 are concluded by the engagement of the cam 242 with the stop rod 238. The housings 42 and 230 are so related to each other that at the conclusion of the rearward movement of the detector finger 68 into engagement with the toe end extremity of the shoe assembly 252, as described above, the stop rod 238 which is mounted to move in unison with the housing 230 is so located as to be engaged by the cam 242 when the nozzle tips 250 are at the boundaries 294 (FIG. 22) between the previously lasted toe portion 280 of the upper margin and the unlasted side portion 288 of the upper margin with the nozzle tips 250 extending beneath the upper margin at the boundaries 294 and extending outwardly of the heel-toe axis of the shoe assembly 252 as indicated by position B in FIG. 22.

Just prior to the engagement of the top rod 238 by the cam 242, the cam 242 engages and shifts the valve 234.

This shifting of the valve 234, after the terminations of the cement applying strokes of the nozzles 144, so actuates the cement extruding mechanism 124, in the manner shown in U.S. Pat. No. 4,082,060, as to terminate the forcing of cement out of the nozzle tips 250. At about the same time, pursuant to the shifting of the valve 234, the piston rods 142 are retracted into their idle positions in the motors 140 so as to swing the nozzles 144 rearwardly and inwardly back to their idle positions to enable the nozzles 144 to be withdrawn from under the overhanging margin segments at the boundaries 294 and thus enable the nozzles 144 to be returned to their idle positions, as described below, without the nozzle tips 250 being smeared by the previously extruded cement and without interference from the overhanging margin segments. At about the same time, the motor 150 is so actuated as to retract its piston rod 152 into the cylinder 148 to thereby swing the nozzles 144 inwardly about the axes of the spindles 134 with the stop bolts 154 engaging the lugs 156.

Now the piston rods 166 are projected out of the motors 162 to raise the nozzles 144 to their raised positions, the piston rods 184 are projected out of the motors 182 to cause the heads 186 to bear against the stabilizer bolts 180, and the piston rod 120 is retracted into the motor 118 to cause the plate 112 and the nozzles 144 to move rearwardly until the post 220 again engages the piston rod 224. After this, in the manner shown in U.S. Pat. Nos. 3,963,840 and 4,082,060, the side lasting instrumentalities 286 are moved inwardly and the heel wipers 92 are moved forwardly and inwardly to thereby cause the side lasting instrumentalities and the heel wipers to respectively wipe the side and heel portions of the upper margin against the insole and bond these wiped margin portions to the insole by means of the previously applied cement.

This completes the operation of the machine on the shoe assembly. Those machine parts that have not, earlier in the machine cycle, returned to their idle positions, are now returned to their idle positions and the shoe assembly 252 is removed from the machine.

There follows a recapitulation of the description of the machine parts and the mode of operation of the machine that are pertinent to this invention.

The machine, in accordance with the first aspect of the invention, is operable on the shoe assembly 252 formed of the last 254 having the insole 256 located on its bottom and the upper 258 mounted thereon with a portion (disclosed as the toe portion 280) of the upper margin being wiped against and secured to the insole and an unwiped portion of the upper margin, extending rearwardly of the wiped margin portion, projecting away from the insole periphery and with a segment of the upper margin at the boundary 294 between the wiped and unwiped margin portions overhanging the insole, and has the purpose of applying cement in the corner between the unwiped margin portion and the corresponding portion of the insole periphery. The machine comprises: the shoe assembly support 75 for supporting the shoe assembly 252 bottom-up with the wiped margin portion being forward of the unwiped margin portion; a heightwise extending nozzle 144, located above the shoe assembly 252, having a laterally projecting tip 250 through which cement may be extruded; nozzle mounting means (the mounting of the nozzle holder 138 to the front of the nozzle carrier 136) mounting the nozzle for swinging movement about its heightwise extending axis; forward-rearward moving means (the motor 118) for effecting forward-rearward movements of the nozzle 144 between a rearward position that is rearward of the boundary 294 and a forward position that is located at the boundary 294; heightwise moving means (the motors 162) for effecting heightwise movements of the nozzle 144 between an upper nozzle position wherein the nozzle 144 is spaced above the shoe assembly 252 and a lower nozzle position wherein the nozzle 144 is in engagement with the bottom of the shoe assembly 252; means (components of the machine control circuit that are not shown) for initially causing the forward-moving means 118 and the heightwise moving means 162 to locate the nozzle 144 in the rearward and lower nozzle positions; means (components of the machine control circuit that are not shown) for thereafter causing the forward-rearward moving means 118 to move the nozzle 144 to the forward nozzle position in a cement applying stroke; means (the motors 140, 150 and 162 and components of the machine control circuit that are not shown) for so constraining the nozzle 144 during the cement applying stroke that the nozzle tip 250 is in the corner with the nozzle tip 250 projecting outwardly of the nozzle 144 and being beneath the margin segment at the end of the cement applying stroke; means (the cement extruding mechanism 124) effective during the cement applying stroke to extrude cement through the nozzle tip 250 into the corner; means (the motor 140 and components of the machine control circuit that are not shown) effective, subsequent to the completion of the cement applying stroke, to so swing the nozzle 144 about its axis as to move the nozzle tip 250 rearwardly and inwardly and thus move the nozzle tip out from under the margin segment; and means for thereafter causing the heightwise moving means 162 to raise the nozzle 144 to the upper nozzle position.

The machine, in accordance with the second aspect of the invention, is operable on the shoe assembly 252 having the insole 256 located on its bottom and the upper 258 mounted thereon with a portion of the upper margin from its heel and extremity extending toewardly thereof projecting away from the insole, and has the purpose of applying cement in the corner between the margin portion and the corresponding portion of the insole periphery. The machine comprises: the shoe assembly support 76 for supporting the shoe assembly 252 bottom-up with the toe end of the shoe assembly facing forwardly; the nozzle 144, located above the shoe assembly 252, through which cement may be extruded, the forward-rearward moving means 118 for effecting forward-rearward movements of the nozzle 144 between a rearward nozzle position wherein the nozzle 144 is proximate to and forward of the heel end of the margin portion and a forward nozzle position wherein the nozzle is at a forward end of the margin portion; the heightwise moving means 162 for effecting heightwise movements of the nozzle 144 between an upper nozzle position wherein the nozzle 144 is spaced above the insole 256 and a lower nozzle position wherein the nozzle is in engagement with the insole; the post 220 mounted for forward-rearward movement in unison with the nozzle 144; the rod 224, mounted for forward-rearward movement between a front rod position and a back rod position, located rearwardly of and in intersecting relationship with the post 220; means, formed by components of the machine control circuit that are not shown, for initially causing the heightwise moving means 162 to retain the nozzle 144 in the upper nozzle position; means, formed by the motor 222 and components of the machine control circuit that are not shown, for initially causing the rod to be in the front rod position; means, formed by components of the machine control circuit that are not shown, for initially causing the forward-rearward moving means 118 to yieldably move the nozzle 144, together with the post 220, rearwardly with the post 220 engaging the rod 224 in a location wherein the nozzle 144 is in an intermediate position that is between the rearward nozzle position and the forward nozzle position and is relatively close to the rearward nozzle position; means, formed by components of the machine control circuit that are not shown, for thereafter causing the heightwise moving means 162 to lower the nozzle 144 to the lower nozzle position; means, formed by the motor 222 and by components of the machine control circuit that are not shown, for thereafter causing the rod 224 to be moved to the back rod position thereby enabling the forward-rearward moving means 118 to move the post 220, together with the nozzle 144, rearwardly an amount that corresponds to the amount of movement of the rod 224 from the front rod position to the back rod position to thereby place the nozzle 144 in the rearward nozzle position; means, formed by components of the machine control circuit that are not shown, for thereafter causing the forward-rearward moving means 118 to effect forward movement of the nozzle 144 to the forward nozzle position in a cement applying stroke; means, formed by motors 150 and 162 and by components of the machine control circuit that are not shown, effective during the cement applying stroke to retain the nozzle 144 in the corner; and means, formed by the cement extruding means 124, by components of the machine control circuit that are not shown, and by mechanism shown in U.S. Pat. No. 4,082,060, effective during the cement applying stroke to extrude cement through the nozzle 144 into the corner.

The third aspect of the invention relates to a mechanism for performing work (the extrusion of cement) along an upwardly facing portion (the insole 256) of a workpiece (the shoe assembly 252) having a segment (the insole shank portion 266) that is inclined upwardly and forwardly and a remainder (the insole heel seat portion 264 and the insole forepart portion 268) that is not so inclined. The mechanism comprises a tool (one of the nozzles 144), located above the workpiece portion 256, mounted for forward movement and for heightwise movement; forward moving means (the motor 118) for causing the tool 144 to move forwardly in a tool stroke from a rearward tool position wherein the tool is at the rearward end of said workpiece portion to a forward tool position wherein the tool is at the forward end of said workpiece portion; force applying means (the motors 162) for imparting a prescribed yieldable downward force to the tool 144 during the tool stroke; relief means (the appropriate components in the control circuit, not shown, for relieving the downward force applied by the motors 162) for relieving said prescribed force; a control member (the valve actuator 292) actuable to actuate the relief means; and an actuating member (the cam 244) so constructed and arranged as to actuate the control member 292 during that portion of the tool stroke wherein the tool 144 is moving along the workpiece portion segment 266.

The control member 292 is mounted for movement between a first normal position (its upper position) and a second position (its lower position) to which it can be shifted and is so connected to the force applying means 162 as to actuate the relief means when it is in its second position. The cam 244, which forms the actuating member, is connected to the tool 144 for forward movement therewith and is so constructed and arranged as to intersect the control member 292 and shift the control member 292 from its first position to its second position pursuant to the forward movement of the tool 144.

I claim:

1. A machine, operable on a shoe assembly formed of a last having an insole located on its bottom and an upper having a margin mounted thereon with a portion of the upper margin being wiped against and secured to the insole and with an unwiped portion of the upper margin having a boundary with said wiped margin portion, extending rearwardly of said wiped margin portion, projecting away from the insole periphery so as to form a corner between said unwiped margin portion and the corresponding portion of the insole periphery and with a segment of the upper margin at said boundary overhanging the insole, for applying cement in said corner comprising: a shoe assembly support for supporting the shoe assembly bottom-up with said wiped margin portion being forward of said unwiped margin portion; a heightwise extending nozzle, located above the shoe assembly, having a laterally projecting tip through which cement may be extruded; nozzle mounting means mounting the nozzle for swinging movement about its heightwise extending axis; forward-rearward moving means for effecting forward-rearward movements of the nozzle between a rearward nozzle position that is rearward of said boundary and a forward nozzle position that is located at said boundary; heightwise moving means for effecting heightwise movements of the nozzle between an upper nozzle position wherein the nozzle is spaced above the bottom of the shoe assembly and a lower nozzle position wherein the nozzle is in engagement with the bottom of the shoe assembly; means for initially causing the forward-rearward moving means and the heightwise moving means to locate the nozzle in said rearward and lower nozzle positions; means for thereafter causing the forward-rearward moving means to move the nozzle to the forward nozzle position in a cement applying stroke; means for so constraining the nozzle during the cement applying stroke that the nozzle tip is in said corner with the nozzle tip projecting outwardly of the nozzle and being beneath said margin segment at the end of the cement applying stroke; means effective during the cement applying stroke to extrude cement through the nozzle tip into said corner; means, effective subsequent to the completion of the cement applying stroke, to so swing the nozzle about said axis as to move the nozzle tip rearwardly and inwardly and thus move the nozzle tip out from under said margin segment; and means for thereafter causing the heightwise moving means to raise the nozzle to the upper nozzle position.

2. A method, operable on a shoe assembly formed of a last having an insole located on its bottom and an upper having a margin mounted thereon with a portion of the upper margin being wiped against and secured to the insole and with an unwiped portion of the upper margin having a boundary with said wiped margin portion, extending rearwardly of said wiped margin portion, projecting away from the insole periphery so as to form a corner between said unwiped margin portion and the corresponding portion of the insole periphery and with a segment of the upper margin at said boundary overhanging the insole, for applying cement in said corner comprising: supporting the shoe assembly bottom-up with said wiped margin portion being forward of said unwiped margin portion; locating above the shoe assembly a heightwise extending nozzle having a laterally projecting tip through which cement may be extruded, the nozzle being swingable about its heightwise extending axis; initially locating the nozzle in a lower nozzle position in engagement with the shoe assembly bottom and in a rearward nozzle position that is rearward of said boundary; thereafter moving the nozzle in a cement applying stroke to a forward nozzle position that is located at said boundary; so constraining the nozzle during the cement applying stroke that the nozzle tip is in said corner with the nozzle tip projecting outwardly of the nozzle and being beneath said margin segment at the end of the cement applying stroke; extruding cement through the nozzle tip into said corner during the cement applying strokes; swinging the nozzle rearwardly and inwardly about said axis, subsequent to the completion of the cement applying stroke, so as to move the nozzle tip out from under said margin segment; and thereafter raising the nozzle upwardly of the shoe assembly bottom.

3. A machine, operable on a shoe assembly formed of a last having an insole located on its bottom and an upper having a margin mounted thereon between the toe and heel end extremities of the last with a portion of the upper margin from its heel end extremity extending toewardly thereof projecting away from the insole so as to form a corner between said margin portion and the corresponding portion of the insole periphery, for applying cement in said corner comprising: a shoe assembly support for supporting the shoe assembly bottom-up with the toe end of the shoe assembly facing forwardly; a nozzle, located above the shoe assembly, through which cement may be extruded; forward-rearward moving means for effecting forward-rearward movements of the nozzle between a rearward nozzle position wherein the nozzle is proximate to and forward of the heel end of said margin portion and a forward nozzle position wherein the nozzle is at a forward end of said margin portion; heightwise moving means for effecting heightwise movements of the nozzle between an upper nozzle position wherein the nozzle is spaced above the insole and a lower nozzle position wherein the nozzle is in engagement with the insole; a post mounted for forward-rearward movement in unison with the nozzle; a rod, mounted for forward-rearward movement between a front rod position and a back-rod position, located rearwardly of an in intersecting relationship with the post; means for initially causing the heightwise moving means to retain the nozzle in the upper nozzle position; means for initially causing the rod to be in the front rod position; means for initially causing the forward-rearward moving means to yieldably move the nozzle, together with the post, rearwardly with the post engaging the rod in a location wherein the nozzle is in an intermediate nozzle position that is between the rearward nozzle position and the forward nozzle position and is relatively close to the rearward nozzle position; means for thereafter causing the heightwise moving means to lower the nozzle to the lower nozzle position; means for thereafter causing the rod to be moved to the back rod position thereby enabling the forward-rearward moving means to move the post, together with the nozzle, rearwardly an amount corresponding to the amount of rearward movement of the rod from the front rod position to the back rod position to thereby place the nozzle in the rearward nozzle position; means for thereafter causing the forward-rearward moving means to effect forward movement of the nozzle to said forward nozzle position in a cement applying stroke; means effective during the cement applying stroke to retain the nozzle in said corner; and means effective during the cement applying stroke to extrude cement through the nozzle into said corner.

* * * * *